US009366506B2

(12) United States Patent
Willson et al.

(10) Patent No.: US 9,366,506 B2
(45) Date of Patent: Jun. 14, 2016

(54) COATED BALLISTIC STRUCTURES AND METHODS OF MAKING SAME

(71) Applicants: Robert M. Willson, Kettering, OH (US); Michael C. Willson, Troy, OH (US); Anil R. (Neil) Chaudhry, Xenia, OH (US)

(72) Inventors: Robert M. Willson, Kettering, OH (US); Michael C. Willson, Troy, OH (US); Anil R. (Neil) Chaudhry, Xenia, OH (US)

(73) Assignee: APS MATERIALS, INC., Dayton, OH (US)

( * ) Notice: Subject to any disclaimer, the term of this patent is extended or adjusted under 35 U.S.C. 154(b) by 121 days.

(21) Appl. No.: 14/031,070

(22) Filed: Sep. 19, 2013

(65) Prior Publication Data

US 2014/0208929 A1 Jul. 31, 2014

Related U.S. Application Data

(60) Provisional application No. 61/702,772, filed on Sep. 19, 2012.

(51) Int. Cl.
*F41H 5/02* (2006.01)
*F41H 5/04* (2006.01)

(52) U.S. Cl.
CPC ..... *F41H 5/0421* (2013.01); *F41H 5/0414* (2013.01); *F41H 5/0442* (2013.01); *F41H 5/0492* (2013.01); *Y10T 428/12535* (2015.01); *Y10T 428/12576* (2015.01); *Y10T 428/26* (2015.01)

(58) Field of Classification Search
CPC ... F41H 5/0492; F41H 5/0414; F41H 5/0442; F41H 5/0471; F41H 5/02; F41H 5/0421; F41H 7/04; F41H 1/00; B23P 9/00; Y10T 29/49746
USPC ..... 89/36.01, 36.02, 36.05; 427/404, 419.2, 427/422, 427, 453, 405, 446
See application file for complete search history.

(56) References Cited

U.S. PATENT DOCUMENTS

| | | | | |
|---|---|---|---|---|
| 4,945,814 | A | 8/1990 | Huet | |
| 5,043,182 | A | 8/1991 | Schultze et al. | |
| 5,194,202 | A | 3/1993 | Yun et al. | |
| 5,211,776 | A | 5/1993 | Weiman | |
| 5,361,678 | A | 11/1994 | Roopchand et al. | |
| 5,686,689 | A | 11/1997 | Snedeker et al. | |
| 5,763,813 | A * | 6/1998 | Cohen et al. | 89/36.02 |
| 6,143,432 | A * | 11/2000 | de Rochemont et al. | 428/689 |
| 6,601,497 | B2 | 8/2003 | Ghiorse et al. | |
| 6,737,105 | B2 * | 5/2004 | Richard | 427/162 |

(Continued)

FOREIGN PATENT DOCUMENTS

| | | |
|---|---|---|
| CN | 101158564 | 4/2008 |
| CN | 101658973 | 3/2010 |

*Primary Examiner* — Benjamin P Lee
(74) *Attorney, Agent, or Firm* — Thompson Hine LLP

(57) ABSTRACT

A durable ceramic and metallic coating has been applied to ceramic tiles to protect the tiles while undergoing a molten metal casting operation. The plasma sprayed coating consists of a ceramic top coat layer of aluminum oxide, zirconium oxide, or other oxides with or without a metallic bond coat layer and with or without a functionally gradient coating. This coating protects the underlying ceramic tile, which is composed of boron carbide, silicon carbide, alumina ($Al_2O_3$) or other type of hard ceramic, from reacting chemically with the molten metal. The molten metal is cast around the ceramic tiles to create a lattice of ceramic tiles that are used for protection from projectiles and shrapnel.

10 Claims, 7 Drawing Sheets

(56) References Cited

U.S. PATENT DOCUMENTS

| | | | | |
|---|---|---|---|---|
| 7,069,836 | B1 | 7/2006 | Palicka et al. | |
| 7,077,306 | B2 | 7/2006 | Palicka et al. | |
| 7,128,963 | B2 | 10/2006 | Benitsch | |
| 7,157,158 | B2 | 1/2007 | Collier et al. | |
| 7,833,627 | B1 | 11/2010 | Ferrando | |
| 7,910,219 | B1 | 3/2011 | Withers et al. | |
| 7,926,543 | B2 | 4/2011 | Sugawara et al. | |
| 8,047,116 | B2 | 11/2011 | Neal et al. | |
| 8,091,204 | B2 * | 1/2012 | DiPietro | 29/458 |
| 8,377,512 | B2 * | 2/2013 | Chu et al. | 427/258 |
| 8,628,857 | B2 * | 1/2014 | Simovich | 428/446 |
| 8,960,262 | B2 * | 2/2015 | Grozdanich et al. | 164/75 |
| 2011/0017056 | A1 | 1/2011 | Chu et al. | |
| 2011/0220280 | A1 | 9/2011 | DiPietro | |

* cited by examiner

COATED BALLISTIC STRUCTURES AND METHODS OF MAKING SAME

RELATED APPLICATION

This application claims the benefit of U.S. Provisional Application No. 61/702,772 filed Sep. 19, 2012.

TECHNICAL FIELD

The present invention relates generally to ballistic structures such as tiles, plates, or armor whether for a person, vehicle, or aircraft and, more particularly, to a coated ballistic structure capable of encapsulation in a molten metal.

BACKGROUND

Desired armor protection levels can usually be obtained if weight is not a consideration. However, in many armor applications, there is a premium put on lightweight armor. Some areas of application where lightweight armor are important include ground combat and tactical vehicles, portable hardened shelters, helicopters, and various other aircraft used by the Army and the other Services. Another example of an armor application in need of reduced weight is personnel body armor worn by soldiers and law enforcement personnel.

There are two prevalent hard passive armor technologies in general use. The first and most traditional approach makes use of metals such as armor grade steel. The second approach uses ceramics. Each material has certain advantages and limitations. Broadly speaking, metals are more ductile and are generally superior at withstanding multiple hits. However, they typically have a large weight penalty and are not as efficient at stopping armor-piercing threats. Ceramics are extraordinarily hard, strong in compression, lighter weight, and brittle, making them efficient at eroding and shattering armor-piercing threats, but not as effective at withstanding multiple hits.

Attempts to take advantage of the best characteristics of the metal and the ceramic have been tried. For example, ceramic tiles have been encapsulated in a metal framework using a hot-press process followed by extensive grinding and finishing to produce an acceptable armor article. The grinding and finishing (post-processing) steps are expensive and time consuming processes. Moreover, additional processing is required to build the metal matrix or frame that connects multiple ceramic tiles. The metal frame is typically a piece of solid steel precision machined to create openings that mirror the tile dimensions or is slightly undersized then heated and the tiles are shrink fit into the matrix. Metal plates are then added to both the front and back of the metal frame and super-plastically bonded to the metal frame thus totally encapsulating the tiles. This process is lengthy and costly.

One such method of encasing ceramic tiles in a metal frame is disclosed in U.S. Pat. No. 5,686,689 to Snedeker, et al. Ceramic tiles were placed into individual cells of a metallic frame consisting of a backing plate and thin surrounding walls. A metallic cover was then welded over each cell, encasing the ceramic tiles. A benefit to encasing the ceramic tile is that once fractured pieces cannot move away easily and a degree of protection is maintained in the area of the ceramic tile.

Substantial development efforts are ongoing with metal encapsulated ceramic tiles or plates to find more cost-effective and faster production methods that utilize the advantages of both materials to maintain or lower the armor's weight and to decrease the negative effects of fractured tiles such as reduced penetration resistance and damage to neighboring tiles, while also improving the ceramic's integrity during the metal encapsulation process.

SUMMARY

Durable ceramic and metallic coatings applied to ceramic substrates of various shapes and sizes suitable for ballistic and/or armor applications are disclosed herein that protect the tiles while undergoing a molten metal casting operation. The ceramic and metallic coatings are preferably plasma sprayed coating that include a ceramic top coat layer of aluminum oxide, zirconium oxide, or other oxides with or without a metallic bond coat layer. This coating protects the underlying ceramic tile, which is composed of boron carbide, silicon carbide, alumina ($Al_2O_3$) or other type of hard ceramic, from reacting chemically with the molten metal. Molten metal is cast around the ceramic tiles to create a lattice of ceramic tiles that are used for protection from projectiles and shrapnel.

DETAILED DESCRIPTION

Figure 1:
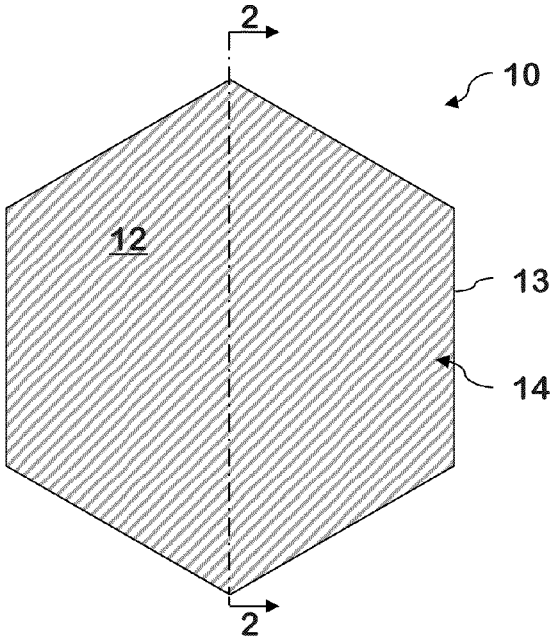
FIG. 1 is a top view of a hexagonally-shaped tile.

The following detailed description will illustrate the general principles of the invention, examples of which are additionally illustrated in the accompanying drawings. In the drawings, like reference numbers indicate identical or functionally similar elements.

Armor components disclosed herein provide the ability for ceramic tiles to be successfully encapsulated in metal via a casting process utilizing molten metal to form an armor member. The armor member and the method of making the same do not chemically degrade or crack the ceramic tiles or the surrounding steel. The armor components comprise a ceramic substrate or other similar hard substrate suitable for ballistic and/or armor applications coated with a material that protects the underlying ceramic tile from chemical and thermal interactions with the molten metal during the casting process. The coating on the tiles also minimizes stresses, coating spallation, delamination caused by the molten metal and/or by the solidifying metal (including the change in stresses when the metal changes from molten to solid).

One challenge is to cast the molten metal (for example, steel) around the tile without cracking the tile. The mismatch in the coefficient of thermal expansion ("CTE") of the tile relative to the metal causes relatively high thermal loading and strain in both the tile and the surrounding metal, which may both crack. To adequately address the CTE mismatch, reduce processing risk, and improve the ballistic performance, a coating, in particular a thermal sprayed coating such as a plasma sprayed coating, a flamed coating, or any variation of a thermal coating, is applied to the tile. In one embodiment, the coating is applied to a SiC or $Al_2O_3$ ceramic tile, which is then cast into a steel matrix.

FIG. 1 is a top view of an armor component 10 that includes a tile 12 having a perimeter 13 and a coating 14 on both primary faces and the perimeter of the tile. In other words, the tile is essentially, completely surrounded by the coating 14 as shown in the cross-section in FIG. 2. While the tile 12 illustrated in FIG. 1 is hexagonal in shape, there is no limit to the shape of the tile or plates to be coated by coating 14. Moreover, the armor component 10 may be also be a plate, panel, or other substrate for ballistic, defense, and/or armor applications such as those for the body, vehicle, aircraft, etc. The word "tile" as used herein is meant to be and include other forms of ballistic, defense, and/or armor substrates, including plates, panels, and the like.

Figure 4A:
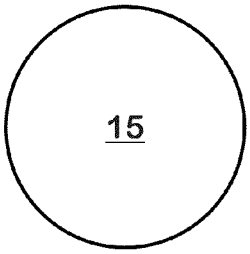
FIGS. 4A-4E are illustrations of alternate exemplary shapes for an armor tile.
Figure 4B:
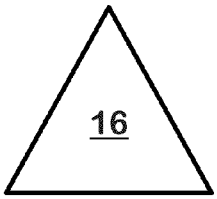
Figure 4C:
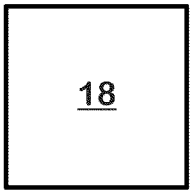
Figure 4D:
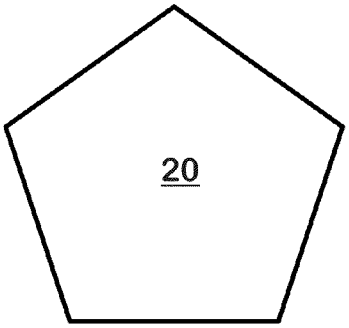
Figure 4E:
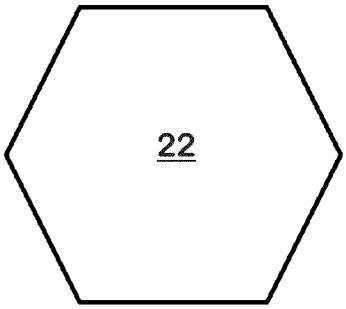

As seen in FIGS. 4A-4E, the tiles or plates may have any number of alternate shapes and again are not limited to those illustrated herein. In the embodiment in FIG. 4A the tile or plate may be a circular shaped tile 15. FIG. 4B shows a triangular tile 16, FIG. 4C shows a quadrilateral tile 18, FIG. 4D shows a pentagonal tile 20 and FIG. 4E shows a hexagonal tile 22. The shapes shown in FIGS. 1 and 4A-4D are by way of example only. Other polygonal shapes may be used. In addition, the shape of the tile need not be a regular geometric shape. The tile may have any shape needed for a particular application.

The core of the armor component 10, as mentioned above, is preferably a tile 12 or plate of or including a ceramic material selected from the group consisting of aluminum oxide, silicon carbide, boron carbide, titanium diboride, aluminum nitride, silicon nitride and tungsten carbide. Tile 12 may also be made of any hard, high compressive strength material having a Vickers hardness of about 12 GPa or greater and a compressive strength of about 2 GPa or greater.

The material for the coating 14 may be, but is not limited to, a plasma-sprayable ceramic or cermet material such as aluminum oxide, magnesium aluminate spinel, zirconium oxide, other oxides, and combinations thereof "Cermet" means a material comprising a metal or a metal alloy and a ceramic powder or a mixture of ceramic powders. Cermet is fabricated from the ceramic powder selected from a group of compounds represented and exemplified by the titanium-aluminum oxide system. Other systems, such as and including zirconium, hafnium, beryllium, vanadium oxides, nitrates, silicates or borides, etc., in combination with a metal, such as titanium, aluminum, magnesium, nickel, lithium, calcium, or their alloys are equally suitable for fabrication of cermets of the invention. In addition to these named systems, any other suitable alloy system meeting the general conditions for processing of the cermets may also be advantageously used to fabricate these cermets using the molten-metal-infiltration method and process and are intended to be within the scope of the invention. In one embodiment, the cermet may be a mixture of a ceramic, such as for example, aluminum oxide, zirconium oxide, hafnium oxide, beryllium oxide, vanadium oxide, boron carbide, aluminum nitride, zirconium nitride, hafnium nitride, vanadium nitride, aluminum boride, zirconium boride, hafnium boride, vanadium boride, aluminum silicate, zirconium silicate, hafnium silicate, vanadium silicate powders or their mixtures, in combination with a metal such as titanium, aluminum, magnesium, nickel, lithium, calcium, or other suitable metals, or their alloys, etc.

These materials may be provided as a powder for use in plasma spraying. The powder may have an average particle size of about 5 μm to about 120 μm, preferably about 10 μm to about 50 μm.

Figure 2:
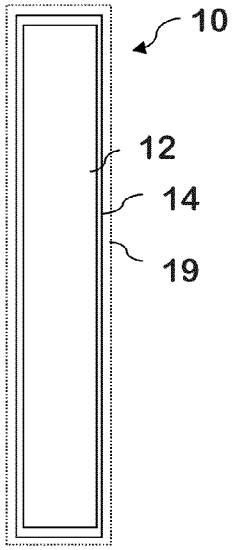
FIG. 2 is a cross-sectional view of the tile of FIG. 1 taken along line 2-2.

The coating 14, which forms a layer on the tile 12 as illustrated in FIG. 2, may be plasma sprayed onto the tile 12 or other armor component 10 at a thickness of about 0.001 to about 0.125 inches thick. In one embodiment, the coating 14 is about 0.002 to about 0.005 inches thick.

In one embodiment, the coating 14 may be a functionally graded coating applied to tile 12 where the surface coating CTE will match that of the tile surface and functionally change as one moves further from the tile surface. The outer or exposed part of the coating will ultimately match the surrounding metal matrix CTE (metal that is poured to encapsulate the tiles). When the metal is investment cast around the tiles and begins to solidify, the stresses will be reduced on the metal matrix and the tile surface as the CTE mismatch is minimized. An important feature of these coatings is their ability to form a barrier layer between the tile and the molten metal to eliminate degradation of the tiles whether chemical or mechanical.

As shown in FIG. 2, the armor component 10 may also include an optional metallic bond coating 19 that defines a layer external to the coating 14 to enhance the armor component's adhesion/bond to molten metal during a casting process. The metallic bond coating 19 may be an additional plasma spray coating.

The optional metallic bond coating 19 may be a metal or metal alloy layer applied to coating 14. The metal or metal alloy may be a powder for thermal spray applications such that the bond coat may be provided as a plasma spray coating. The metallic bond coating 19 may be applied at a thickness of about 0.002 to about 0.004 inches. In one embodiment, the metallic bond coating 19 is about 0.003 inches thick. The metal or metal alloy may be a powder, for example, but not limited to, an aluminum, cobalt, copper, iron, molybdenum, nickel metal or metal alloys.

Figure 3:
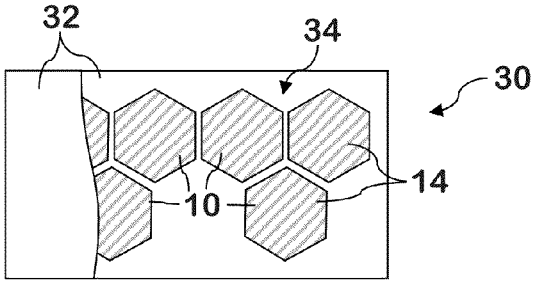
FIG. 3 is partial cut-way top plan view of an armor member that includes the tiles of FIG. 1.

Referring now to FIG. 3, another aspect of the invention is an armor member 30 comprising a metal encapsulate 32 and at least one tile array layer 34 encapsulated by the metal. The tile array layer 34 is comprised of a plurality of armor components 10 wherein each armor component 10 comprises a tile or plate having a coating 14, as discussed above. The materials of construction, shapes and features of the armor components 10 used in the armor member 30 are as discussed previously. The tile array layer 30 may be comprised of a variety of shapes of components 10. The important feature is that the tile array layers provide as much coverage as possible for the intended item to be protected whether a vehicle, airplane, building, or person. To this end, various regular and irregular shapes may be combined within a single layer to obtain as much coverage as possible. While hexagonal-shaped tiles 12 are shown in FIG. 3, the methods of arranging the components 10 to provide maximum coverage of the underlying body to which the armor member 30 may be attached are applicable to any shape of tile.

Figure 5A:
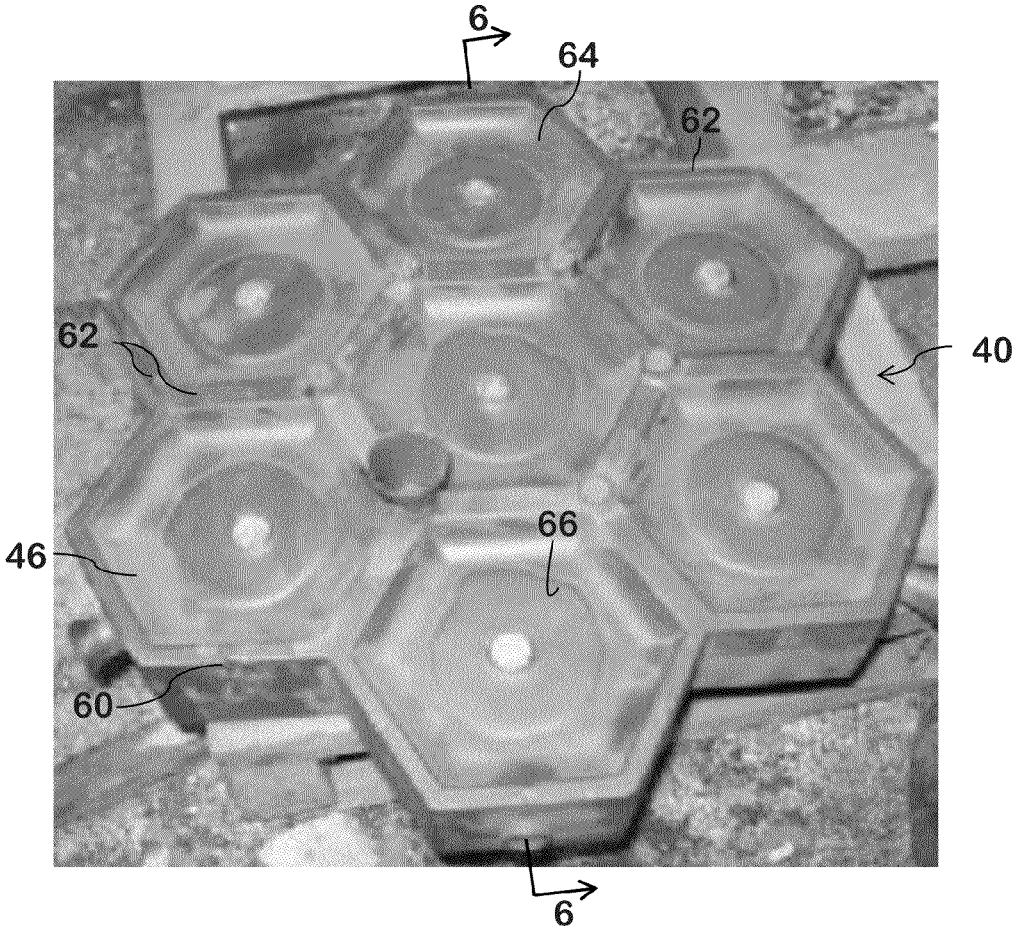
FIG. 5A is a photograph of one embodiment of an armor member having seven tiles encapsulated in metal.
Figure 5B:
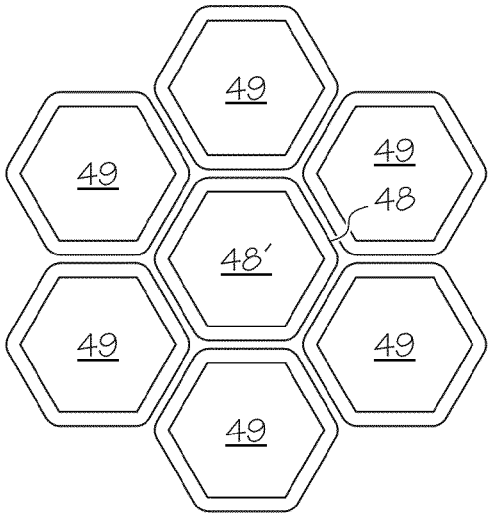
FIG. 5B is an illustration of one arrangement of seven tiles encapsulated within the armor member of FIG. 5A.
Figure 6:
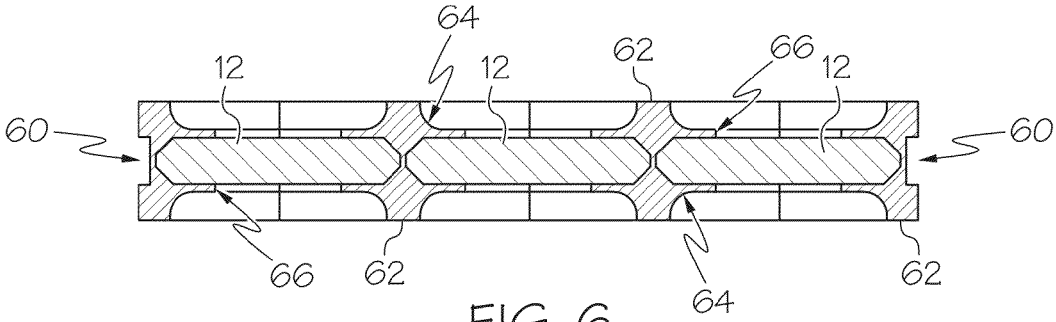
FIG. 6 is an illustration of the armor member of FIG. 5A taken along line 6-6.

In another embodiment, the photograph of FIG. 5, armor member 40 includes seven tiles 12 having coating 14 which are encased in solid metal 46. This embodiment includes seven tiles in an arrangement where, as depicted in FIG. 5B, a first tile 48 is designated as the central tile 48' and the remaining six tiles 49 are arranged equally distant about the central tile and equally distant apart from one another. In one embodiment, the tiles are spaced apart about 1/16 inch to about one inch, and preferably are spaced apart about ⅛ inch from all adjacent sides of neighboring tiles. As seen in FIG. 5A and FIG. 6, the armor member may include sides 60 of metal defining the central portion of the exterior perimeter of the armor member and ridges 62, which are thicker than the sides and are disposed over all the seams between the tiles 12 and along the upper and lower outer perimeter of the armor member (i.e., above and below the sides 60). Extending from the ridges 62 onto outer major surfaces of the tiles 12 (the front and back faces of the tiles 12) are flanges 64, which define holes 66 exposing the center of the front and back faces of the tiles. In another embodiment, the metal may completely cover the front and back faces of the tiles 12 such that no flanges 64 are present. The armor members 30 and 40 may be cast using foam pattern technology as explained below.

Figure 7A:
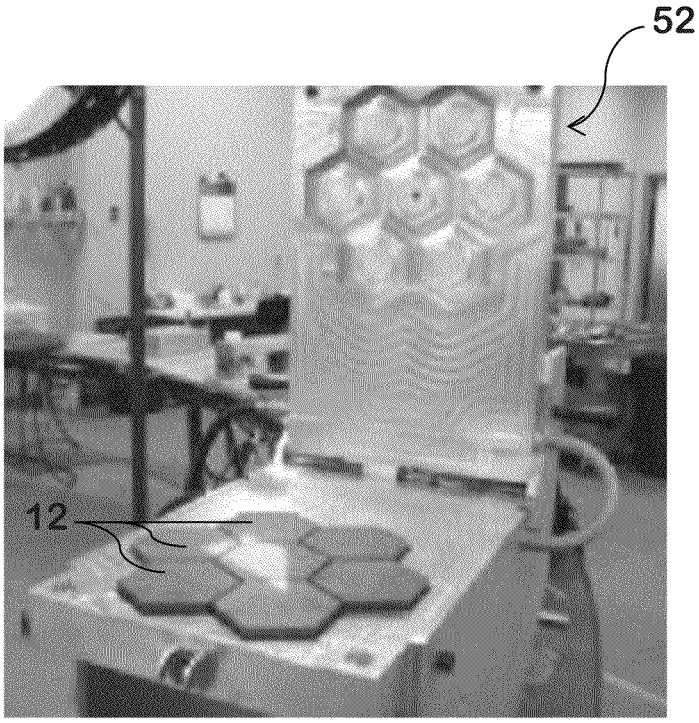
FIGS. 7A and 7B are photographs of a primary mold to make a foam pattern to make the armor member of FIG. 5A.
Figure 7B:
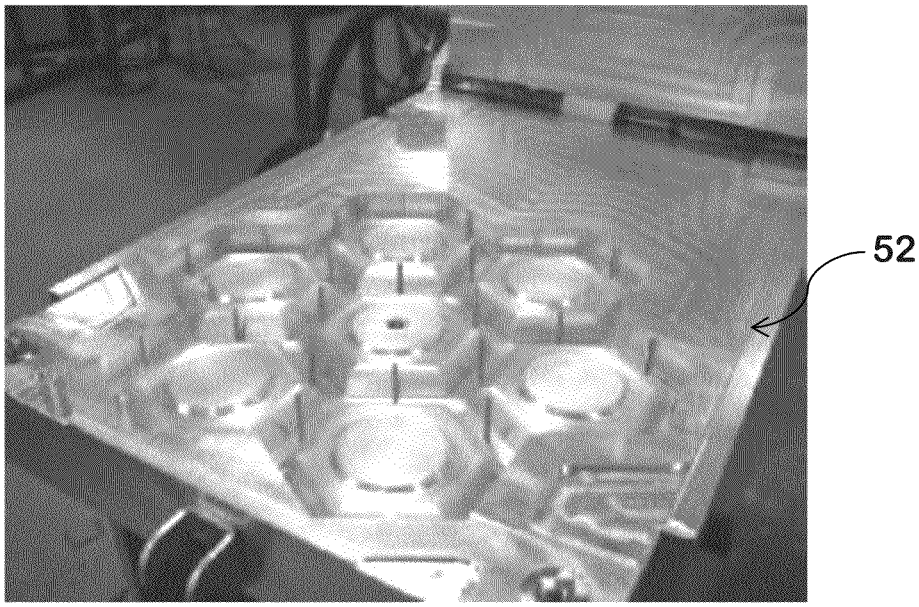
Figure 8:
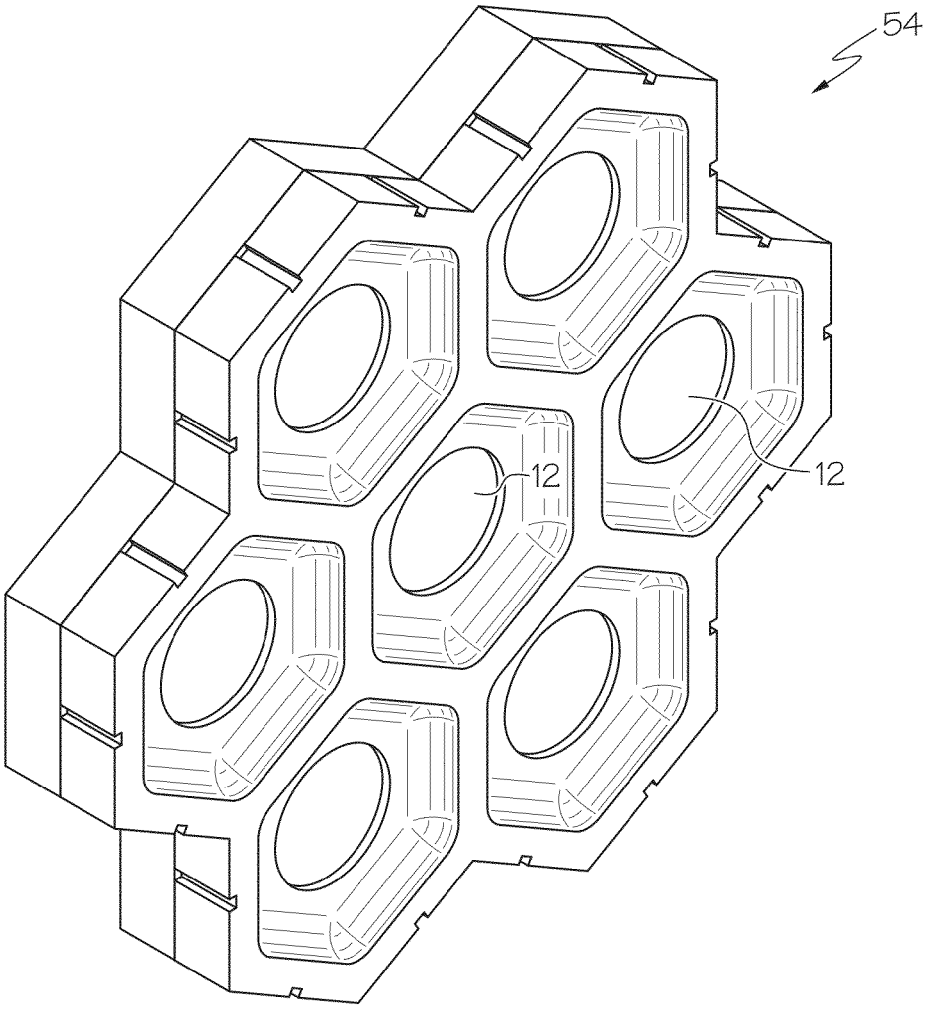
FIG. 8 is an image of one embodiment of a foam pattern that results from the molds in FIGS. 7A-7B.

One method of encapsulating one or more tiles 12 in molten metal is an investment casting technology called foam pattern technology ("FOPAT"). Foam pattern casting is advantageous over the lost-wax method for casting an array of armor components because it is more rigid and dimensionally more stable. FOPAT uses various polymers in combination with a modified reaction injection molding process and alternate tooling methods to produce investment casting patterns. The reaction injection molding is a polymer fabrication technique involving the extremely rapid impingement mixing of two chemically reactive liquid streams that are injected into a mold, resulting in simultaneous polymerization, cross-linking, and formation of the desired shape. FIGS. 7A-7B are photographs of one example of a primary mold 52 for making a foam pattern to encapsulate a seven tile configuration such as that shown in FIG. 5B to produce the armor member in FIG. 5A. In FIG. 7A seven tiles 12 are disposed in the mold and await an overmold of foam material. Once the foam material is molded over the tiles 12, a foam pattern 54 results (FIG. 8) and is then removed from the primary mold 52.

Figure 9:
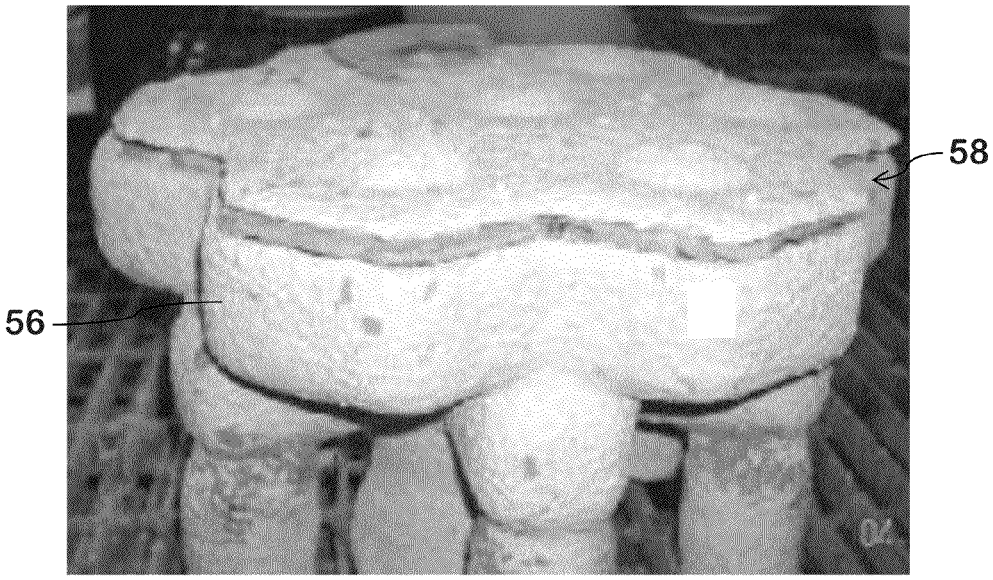
FIG. 9 is a photograph of a ceramic secondary mold surrounding a foam pattern like that of FIG. 8.

Thereafter, the foam pattern 54 is invested in a mold, as in conventional investment mold production, for example, as shown in FIG. 9, in a ceramic shell 56 to create a secondary mold 58. The ceramic mold 58 may be made from a slurry of ceramic material, where the ceramic shell builds around the foam pattern 54 as it is repeatedly dipped in the slurry. The ceramic shell 56 is then heated to a high temperature in a heat treatment furnace until the foam material defining the foam portion of the foam pattern 54 evaporates. During this heating step the ceramic shell 56 is sintered and becomes rigid. Once the foam material is evaporated and the ceramic shell 56 is sintered, the second mold 58 is defined as a result of the open cavity surrounding the tiles 12. Molten metal may then be poured into the second mold 58 to cast the armor member 40 such as the one shown in FIG. 5A.

This process does not require a pattern removal step and eliminates the need for an autoclave, which is used to melt and remove wax patterns. Instead, the foam material portion of the foam pattern is burned out during the firing of the ceramic shell 56. Foam pattern technology, with its stronger patterns and unique flow characteristics, is ideal for thin and complex sections. Other benefits of the foam pattern technology include essentially no pattern shrinkage (i.e., stable pattern yield with no shell cracking defects), stronger patterns (enable insertion of the ceramic tiles without pattern defects), stiffer patterns (improves handling, which avoids creep issue experiences with wax molds), pattern storage and shipment without damage or distortion, cost savings (potentially 30% cheaper per pattern), minimal heating required (foam reaction occurs at room temperature), and reduced cost of injection tooling since the foam is injected at lower pressures than wax.

In an alternate method, the foam pattern 54 may be suspended in a vessel that is filled with compacted sand, which is then heated to evaporate the foam material. Thereafter, molten metal may be poured into the vacancies left by the evaporated foam material to form an armor member.

What is claimed is:

1. A method of protecting an article to be cast with molten metal, the method comprising:

providing a core material comprising a ceramic material, the core material having a first coefficient of thermal expansion;

thermal spraying one or more of a ceramic, a cermet, or a metallic material as a coating on the core material, wherein the coating forms a barrier layer on the core material and protects the article during subsequent casting with molten metal, the molten metal having a second coefficient of thermal expansion;

wherein the coating comprises:

a first coating applied to the core material, the first coating comprising a ceramic material, a cermet material, or a combination thereof having a coefficient of thermal expansion most closely matching the first coefficient of thermal expansion; and a second coating over the first coating, the second coating comprising a metallic material and having a coefficient of thermal expansion most closely matching the second coefficient of thermal expansion; and casting the article with molten metal, thereby encapsulating the article in the metal.

2. The method of claim 1, wherein the ceramic or cermet of the coating are selected from the group consisting of aluminum oxide, magnesium aluminate spinel, zirconium oxide, and combinations thereof.

3. The method of claim 1, wherein the article comprises a ceramic tile for ballistic armor.

4. The method of claim 3, wherein the ceramic tile includes aluminum oxide, silicon carbide, boron carbide, titanium diboride, aluminum nitride, silicon nitride or tungsten carbide.

5. The method of claim 1, wherein the article comprises a component that undergoes thermal expansion and thermal shock when molten metal is cast around the article.

6. The method of claim 1, wherein thermal spraying the coating includes plasma-spraying a gradient coating on to the article, wherein the first coating is applied to the tile and functionally changes as one moves further outward from the tile surface to the second coating.

7. The method of claim 1, wherein casting includes foam pattern casting.

8. The method of claim 1, wherein the molten metal comprises steel.

9. The method of claim 1, wherein casting comprising arranging a plurality of the articles in an array before introducing the molten metal.

10. The method of claim 1, wherein casting comprising providing a mold shaped to retain the molten metal as a flange around the article, thereby defining a hole exposing the center of a front face and a back face of the article.

* * * * *